US011504994B1

(12) United States Patent
Leinbach et al.

(10) Patent No.: US 11,504,994 B1
(45) Date of Patent: Nov. 22, 2022

(54) MARKER STAND

(71) Applicant: Big Bee, Little Bee LLC, Huntington Beach, CA (US)

(72) Inventors: Amy Leinbach, Huntington Beach, CA (US); Marlo Parker Leinbach, Huntington Beach, CA (US)

(73) Assignee: Big Bee, Little Bee LLC, Huntington Beach, CA (US)

( * ) Notice: Subject to any disclaimer, the term of this patent is extended or adjusted under 35 U.S.C. 154(b) by 0 days.

(21) Appl. No.: 17/866,508

(22) Filed: Jul. 16, 2022

Related U.S. Application Data

(60) Provisional application No. 63/280,403, filed on Nov. 17, 2021.

(51) Int. Cl.
*B43K 23/04* (2006.01)
*B43M 99/00* (2010.01)

(52) U.S. Cl.
CPC ..... *B43K 23/04* (2013.01); *B43M 99/008* (2013.01)

(58) Field of Classification Search
CPC ..... B43K 23/04; B43M 99/008
See application file for complete search history.

(56) References Cited

U.S. PATENT DOCUMENTS

| | | | | |
|---|---|---|---|---|
| 1,377,097 | A | | 5/1921 | Seaton |
| 1,713,664 | A | | 5/1929 | Kress |
| 1,877,570 | A | | 9/1932 | Gerald |
| 2,415,208 | A | | 2/1947 | Greenberg |
| D155,152 | S | | 9/1949 | Sack |
| 2,907,584 | A | | 10/1959 | Nielsen |
| 3,111,761 | A | | 11/1963 | Mcalister |
| 3,593,856 | A | * | 7/1971 | Zander ..... B43M 99/008 211/69.5 |
| 3,904,029 | A | | 9/1975 | Koltz |
| 4,151,937 | A | | 5/1979 | Haines et al. |
| 4,189,048 | A | | 2/1980 | Gaillard |
| 4,334,622 | A | | 6/1982 | Mutschler |
| 4,355,726 | A | | 10/1982 | Mutschler |
| 4,573,818 | A | | 3/1986 | Kodera |
| 4,757,901 | A | | 7/1988 | Woods |

(Continued)

FOREIGN PATENT DOCUMENTS

| | | | |
|---|---|---|---|
| CA | 1279610 | C | 1/1991 |
| EP | 1527708 | A1 | 5/2005 |

(Continued)

*Primary Examiner* — J C Jacyna
(74) *Attorney, Agent, or Firm* — Headland Law & Strategy; Matthew J. Smyth

(57) ABSTRACT

A stand may include a plurality of cells, each cell having an outer wall, an inner wall, a bottom edge, and a top edge separated from the bottom edge by a height. A perimeter of the outer wall may include a first plurality of segment, and a perimeter of the inner wall may include a second plurality of segments. Each segment in the second plurality of segments may be substantially parallel to a corresponding segment in the first plurality of segments. The cells may be arranged such that the bottom edge of each cell is aligned to a bottom plane, and the cells may be further arranged in at least a first row and a second row, wherein cells in the first row are lower in height than cells in the second row. Adjacent cells may be coupled to each other with a spacing connector that maintains separation therebetween.

20 Claims, 6 Drawing Sheets

(56) References Cited

U.S. PATENT DOCUMENTS

| | | | | | |
|---|---|---|---|---|---|
| 4,773,544 | A | | 9/1988 | McCarthy | |
| 4,826,338 | A | | 5/1989 | Kilpatrick | |
| D305,777 | S | | 1/1990 | Lee | |
| 4,969,568 | A | * | 11/1990 | Yoshida | B43M 99/008 211/186 |
| 5,163,549 | A | | 11/1992 | Hayduchok | |
| 5,232,103 | A | * | 8/1993 | Koenig | B43K 23/002 211/69.5 |
| 5,388,741 | A | | 2/1995 | Hillinger | |
| D357,500 | S | | 4/1995 | Mutterperl | |
| 5,544,764 | A | * | 8/1996 | Cima | B43M 99/008 211/69.5 |
| 5,839,712 | A | | 11/1998 | Wang | |
| 5,988,369 | A | | 11/1999 | Hsu | |
| 6,142,432 | A | | 11/2000 | Amussen | |
| 6,202,862 | B1 | | 3/2001 | Acquaviva et al. | |
| 6,264,080 | B1 | | 7/2001 | Ewing | |
| 6,626,334 | B2 | | 9/2003 | Ewing | |
| 6,871,767 | B2 | | 3/2005 | Perlman et al. | |
| 7,314,142 | B2 | * | 1/2008 | Lyman, Jr. | B43M 99/006 206/214 |
| 8,573,429 | B2 | * | 11/2013 | Hawkins | B65D 25/34 220/23.88 |
| 10,842,264 | B1 | * | 11/2020 | Savryha | A47B 47/0091 |
| 2005/0031403 | A1 | | 2/2005 | Pohmajevich et al. | |
| 2016/0366999 | A1 | * | 12/2016 | Glick | B43M 99/008 |
| 2017/0047754 | A1 | * | 2/2017 | Fochs | H02J 7/0045 |

FOREIGN PATENT DOCUMENTS

| | | | | | |
|---|---|---|---|---|---|
| FR | 2739591 | | * | 4/1997 | B43M 99/008 |
| JP | 6598698 | B2 | | 10/2019 | |
| WO | WO201250523 | A1 | | 4/2012 | |

* cited by examiner

MARKER STAND

CROSS-REFERENCE TO RELATED APPLICATIONS

This application claims the benefit of U.S. Provisional Application Ser. No. 63/280,403, titled "Marker Cap Holder," filed on Nov. 17, 2021; and it incorporates the entire contents of the foregoing application herein by reference.

TECHNICAL FIELD

Various implementations relate generally to a holder for markers and other writing instruments or art supplies.

BACKGROUND

When markers are used for a project, caps may become separated from the corresponding markers. For example, round marker caps may roll off a work surface, particularly when the markers are employed by a young artist. This may result in retrieval operations under and around the work surface, frustration associated with the same, and—if the caps are not timely retrieved—dried out markers. Other round writing instruments and/or their caps, or other art supplies (e.g., paint brushes) may similarly be prone to rolling off a work surface.

SUMMARY

In some implementations, a stand includes a plurality of cells, each cell having an outer wall, an inner wall, a bottom edge, and a top edge separated from the bottom edge by a height. A perimeter of the outer wall may include a first plurality of segments that form a hexagon; a perimeter of the inner wall may include a second plurality of segments; and each segment in the second plurality of segments may be substantially parallel to a corresponding segment in the first plurality of segments.

The plurality of cells may be arranged such that the bottom edge of each cell is aligned to a bottom plane, such that the plurality of cells can be disposed on a flat surface. The plurality of cells may be further arranged in at least a first row and a second row. Cells in the first row may have a first height, and cells in the second row may have a second height that is greater than the first height. Each cell may be coupled to at least one adjacent cell with a spacing connector that maintains separation between the outer wall of the cell and the outer wall of the adjacent cell.

In some implementations, the plane is perpendicular to a longitudinal axis of one or more cells in the plurality of cells. The second height may be greater than the first height by at least 5 mm. One or more cells in the plurality of cells may include ridges that extend out and away from inner walls of the one or more cells.

Cells in the first row and cells in the second row may be offset, such that the plurality of cells is arranged in a honeycomb pattern. A material comprising the plurality of cells is colored orange, gold, brown or amber. The stand may further include indicia that is configured to evoke a honey-related or honeybee-related theme.

The cells may comprise at least one of silicone or rubber. The cells may comprise a material having a coefficient of friction that is greater than plastic. The cells may comprise a material having a Shore A durometer of between 25 and 80.

In some implementations, each segment in the second plurality of segments narrows from the top edge toward the bottom edge, such that the inner wall bounds a volume in the shape of an inverted pyramid or portion thereof. The inner wall bounding the volume may be disposed only at the top of corresponding cells in the plurality of cells; or, the inner wall bounding the volume may extend at least about halfway into corresponding cells in the plurality of cells. Edges of the inverted pyramid may be rounded. The inverted pyramid may have three faces, four faces, five faces, six faces, seven faces or eight faces.

Each spacing connector and cell may be configured such that a segment of an inner wall of a first cell and a parallel segment of an adjacent second cell are separated by at least 10 mm.

The plurality of cells may include a bottom portion and a top portion, where the bottom portion extends from the bottom edge to an intermediate plane; and the top portion is characterized by that remaining portion of the plurality of cells that is not included in the bottom portion. A mass of the bottom portion may be greater than a mass of the top portion. The intermediate plane may be parallel to the bottom plane and disposed (i) halfway to a top edge of a cell in the plurality of cells having the lowest height, (ii) halfway to a top edge of a cell in the plurality of cells having the highest height, or (iii) at a level between (i) and (ii).

In some implementations, a stand includes a plurality of cells, each cell having an outer wall, an inner wall, a bottom edge, and a top edge separated from the bottom edge by a height. A perimeter of the outer wall may include a first plurality of segments; and the inner wall may include a second plurality of segments. Each segment in the second plurality of segments may be substantially parallel to a corresponding segment in the first plurality of segments.

The plurality of cells may be arranged such that the bottom edge of each cell is aligned to a bottom plane, such that the plurality of cells can be disposed on a flat surface; and the plurality of cells may be further arranged in at least a first row and a second row. Cells in the first row may have a first height, and cells in the second row may have a second height that is greater than the first height. Each cell may be coupled to at least one adjacent cell with a spacing connector that maintains separation of at least about 10 mm between the outer wall of the cell and the outer wall of the adjacent cell.

In some implementations, a stand includes a plurality of cells, each cell having an outer wall, an inner wall, a bottom edge, and a top edge separated from the bottom edge by a height. A perimeter of the outer wall may include a first plurality of segments; and a perimeter of the inner wall may include a second plurality of segments. Each segment in the second plurality of segments may be substantially parallel to a corresponding segment in the first plurality of segments. Each segment in the second plurality of segments may narrow from the top edge toward the bottom edge, such that the inner wall bounds a volume in the shape of an inverted pyramid or portion thereof.

The plurality of cells may be arranged such that the bottom edge of each cell is aligned to a bottom plane, such that the plurality of cells can be disposed on a flat surface. The plurality of cells may be further arranged in at least a first row and a second row, wherein cells in the first row have a first height, and cells in the second row have a second height that is greater than the first height. Each cell may be coupled to at least one adjacent cell with a spacing connector that maintains separation between the outer wall of the cell and the outer wall of the adjacent cell.

DETAILED DESCRIPTION

Figure 1:
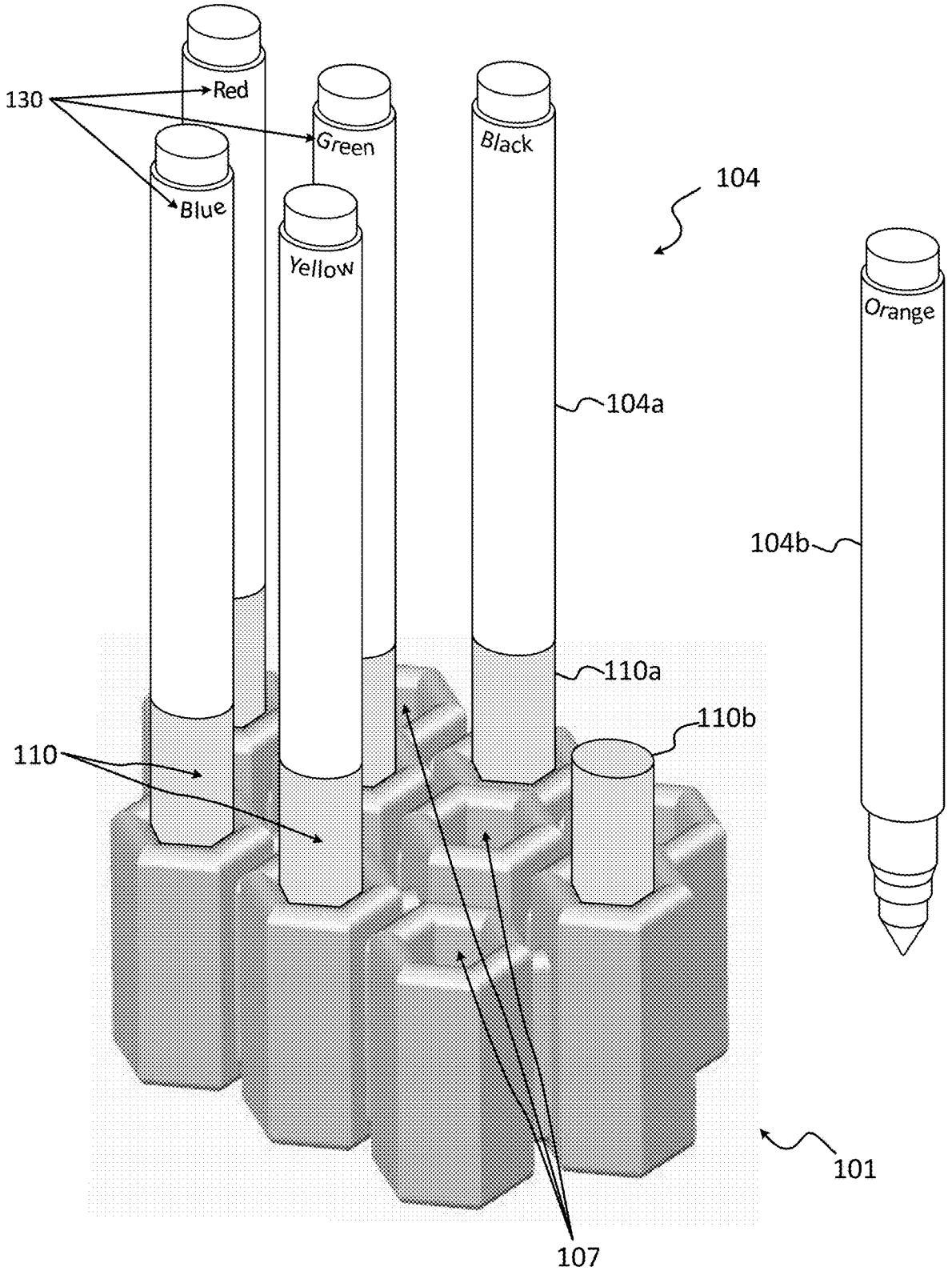
FIG. 1 illustrates an exemplary marker holder.

FIG. 1 illustrates an exemplary marker holder 101, in one implementation, in which it is retaining a plurality of markers 104. As shown, the marker holder includes a plurality of cells 107, each cell of which can be configured to retain a single maker 104*a*. In some implementations, the marker holder 101 retains the markers 104 by their caps 110.

The marker holder 101 may be made of a material that is flexible and that has a coefficient of friction that is higher than that of a material of the marker cap 110, such that the combination of flexibility and coefficients of friction causes the marker holder 101 to "pinch" a marker cap 110*a* of a marker 104*a* that is inserted into a cell in the plurality of cells.

In some implementations, the gripping force of a cell 107 on a marker cap 110*b* may be greater than a gripping force between a marker 104*b* and its cap 110*b*—such that when a user pulls on a marker 104*b* that is disposed in the marker holder 101, the marker itself 104*b* is released, but the cap 110*b* is retained (e.g., as shown in FIG. 1). In such implementations, the marker holder 101 may assist a user in containing and organizing one or more marker caps 110*b*, which, in such implementations, may solve a common problem of marker caps rolling off a table or other work surface while the corresponding marker is in use.

Figure 2A:
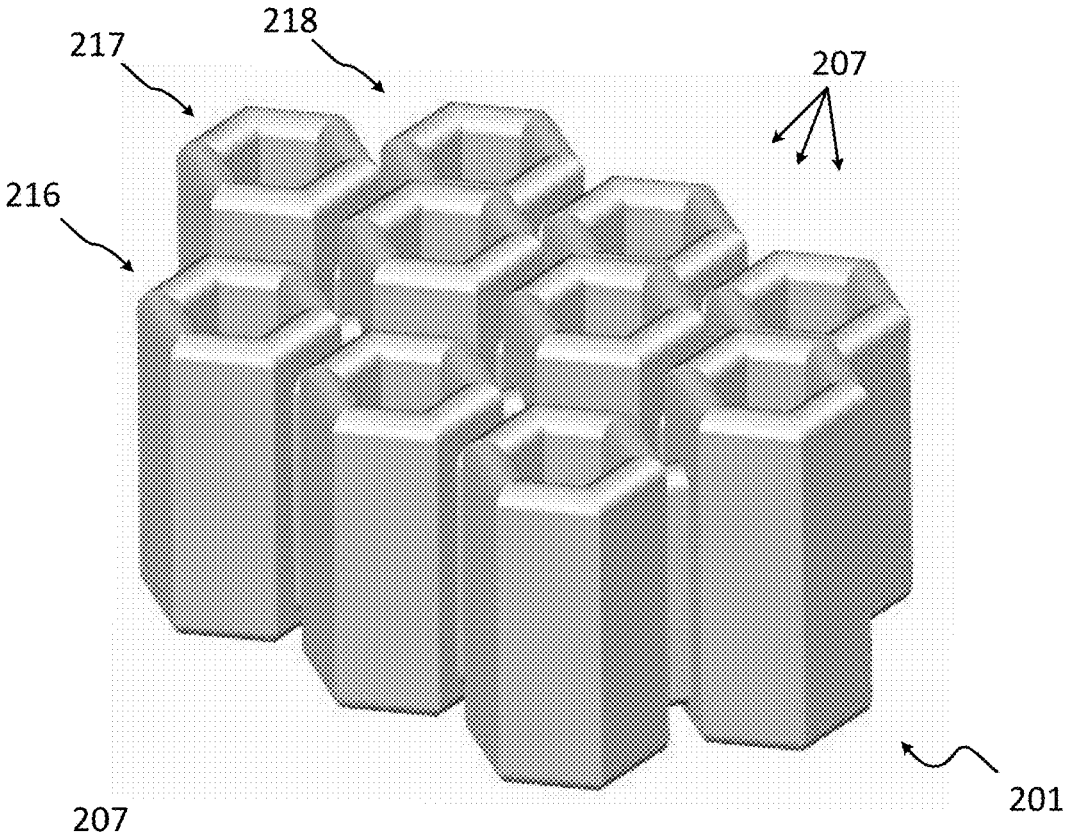
FIG. 2A illustrates a perspective view of the marker holder of FIG. 1.
Figure 2B:
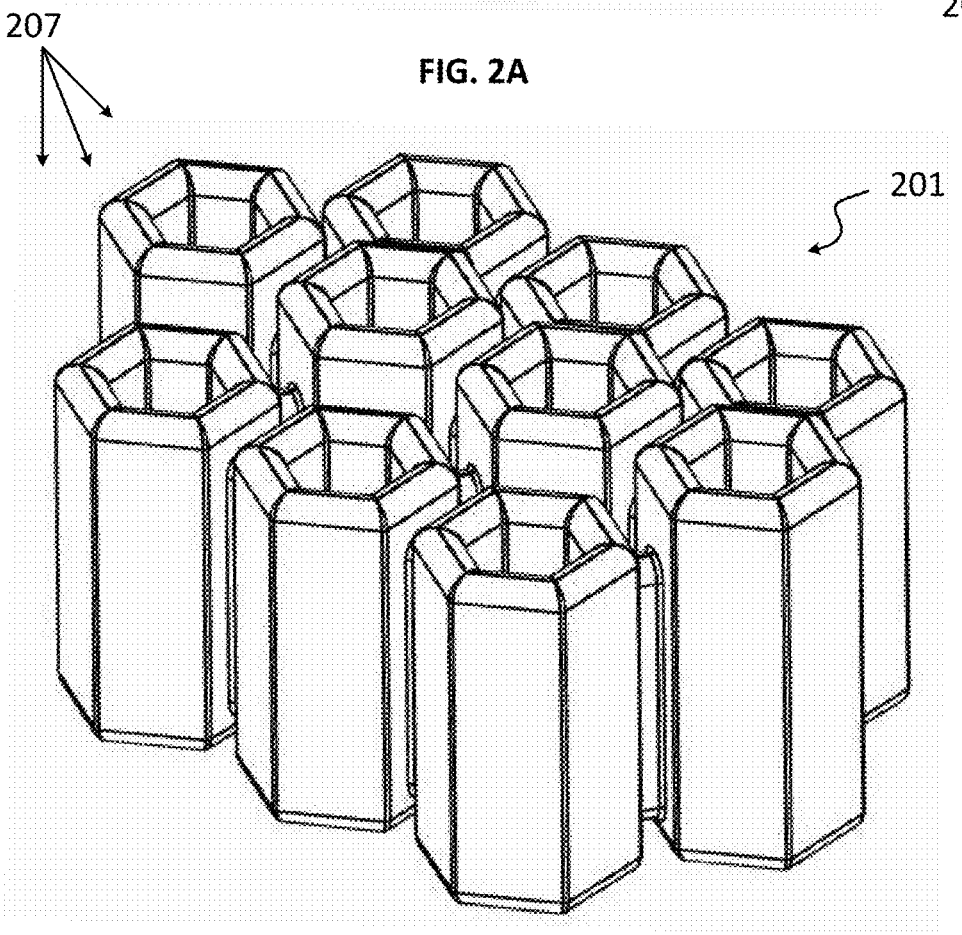
FIG. 2B illustrates a perspective wireframe view of the marker holder of FIG. 2A.
Figure 2C:
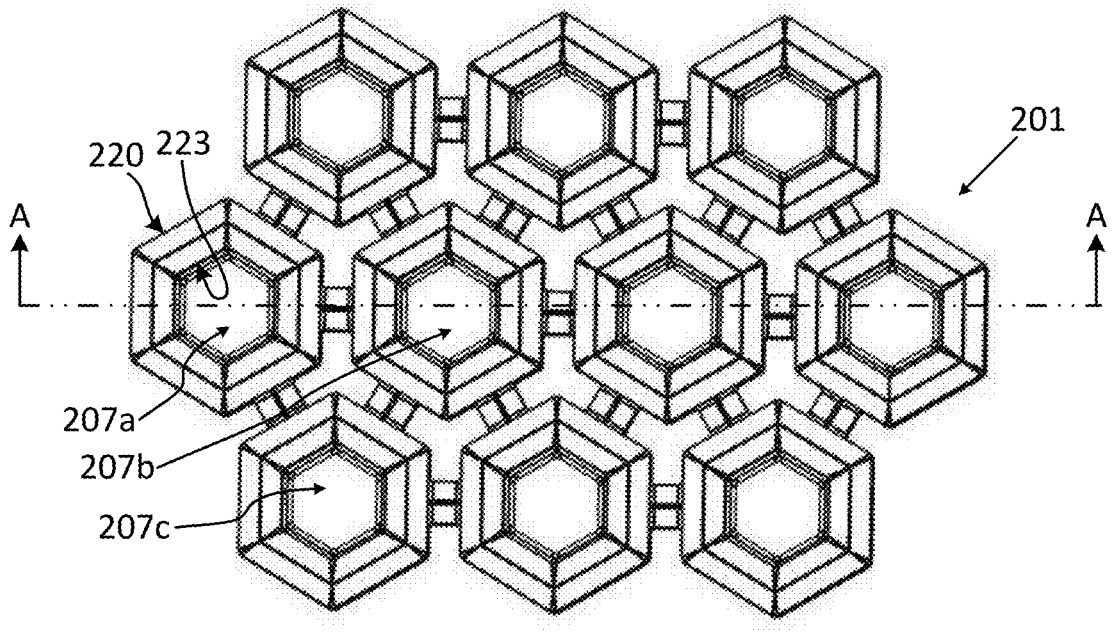
FIG. 2C illustrates a top wireframe view of the marker holder of FIG. 2A.
Figure 2D:
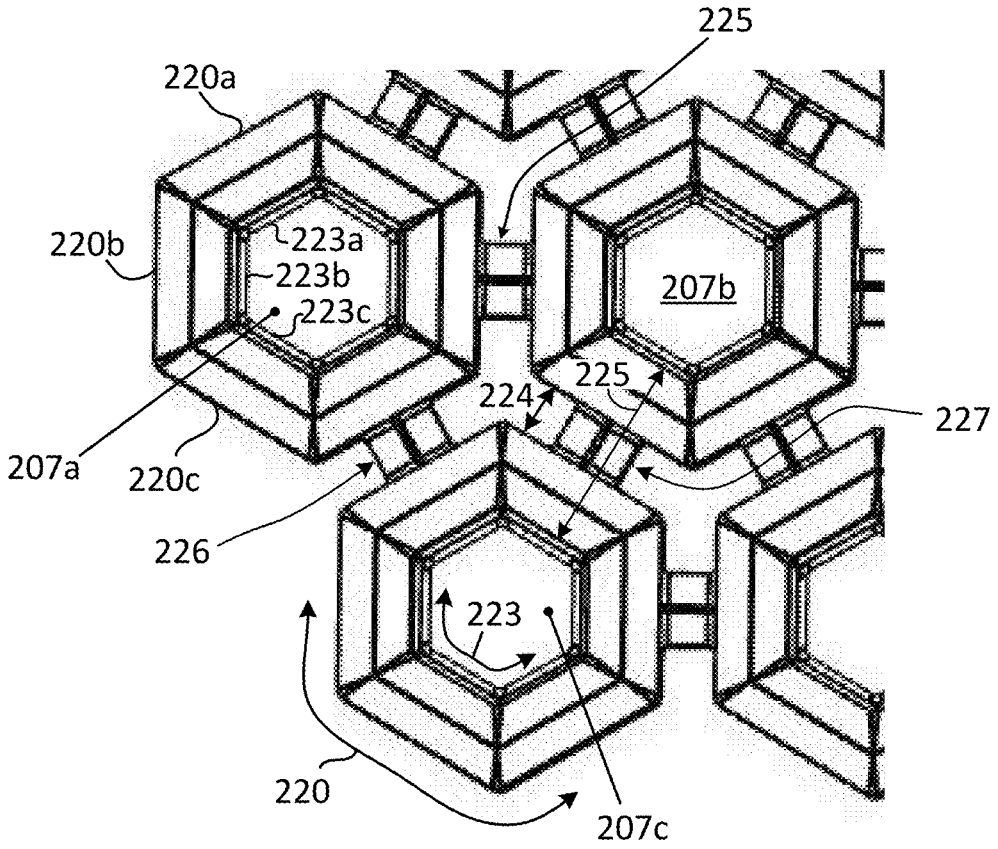
FIG. 2D illustrates a zoomed-in portion of the top wireframe view of the marker holder of FIG. 2C.

FIG. 2A is a shaded perspective view of an exemplary marker holder 201; FIG. 2B is a wireframe perspective view of the marker holder 201; and FIG. 2C is a wireframe top view of the marker holder 201. As shown, the plurality of cells 207 may be arranged in rows. In some implementations, the plurality of cells 207 may be arranged in at least two rows. In some implementations, the plurality of cells may be arranged in at least three rows. For example, FIG. 2A illustrates a first row 216, a second row 217, and a third row 218. Heights of each cell may vary from row-to-row, or from cell-to-cell, or both form cell-to-cell and row-to-row. For example, as shown in FIG. 2F, cells in a first row may have a first height 219, and cells in a second row may have a second height 221.

With reference to FIG. 2C, the marker holder 201 includes a plurality of cells, including cells 207*a*, 207*b* and 207*c*. Each cell includes an outer wall 220 and an inner wall 223. In some implementations, as shown in FIG. 2D, a perimeter of an outer wall 220 may include a plurality of segments (e.g., segments 220*a*, 220*b* and 220*c*); and a perimeter of an inner wall 223 may include a plurality of segments (e.g., segments 223*a*, 223*b* and 223*c*). In such implementations, each segment of the outer wall 220 may be substantially parallel to a corresponding segment of the inner wall 223. For example, segment 220*a* may be parallel to segment 223*a*; segment 220*b* may be parallel to segment 223*b*; and so on.

Figure 2E:
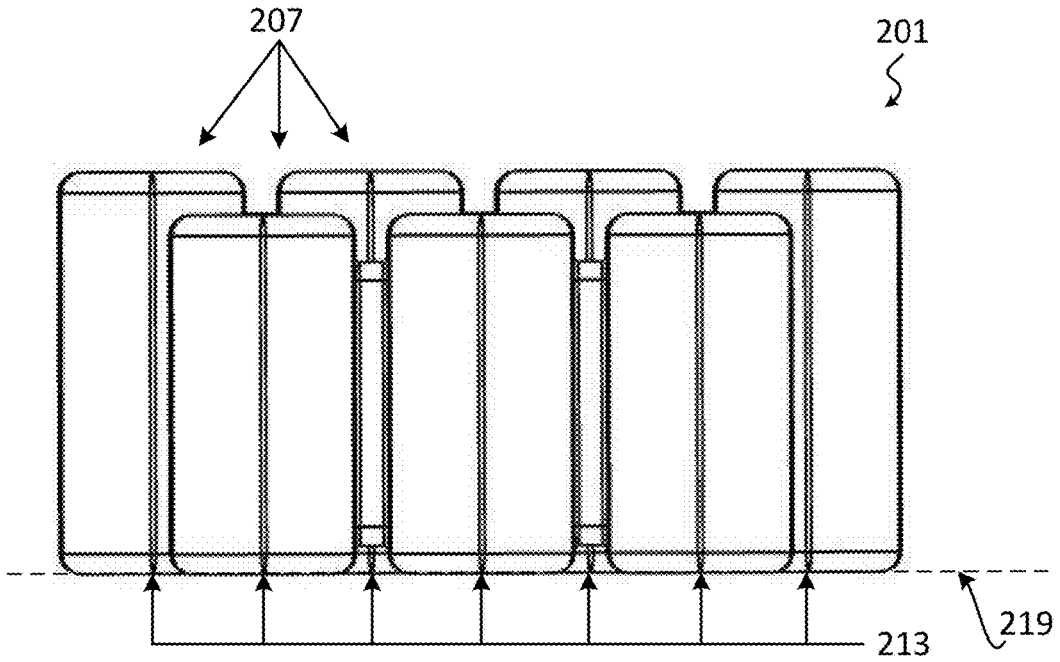
FIG. 2E illustrates a front wireframe view of the marker holder of FIG. 2A.
Figure 2F:
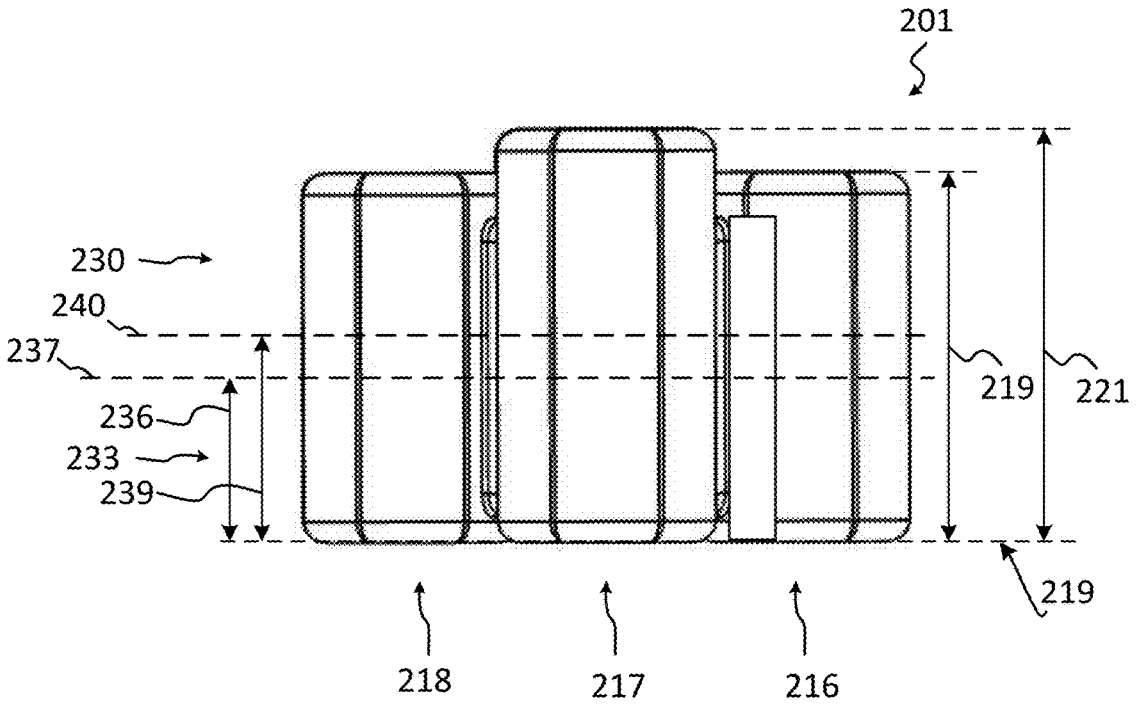
FIG. 2F illustrates a side wireframe view of the marker holder of FIG. 2A.

Turning to FIG. 2E, the plurality of cells 207 may be arranged such that a bottom edge 213 of each cell is aligned to a bottom plane 219 (e.g., one that is perpendicular to a longitudinal axis associated with one or more cells in the plurality of cells 207), such that the plurality of cells 207 may be disposed on a flat surface, regardless of any variation in height from cell-to-cell or row-to-row. In addition, cells in an outer row (e.g., row 216 or row 218 in FIG. 2A) may be aligned such that the plurality of cells 207 may be oriented on its side (e.g., along a side of row 216 or row 218) so that each cell can support a marker in a horizontal position, rather than in the vertical position shown in FIG. 1.

In some implementations, each cell may be coupled to an adjacent cell with a spacing connector. For example, as shown in FIG. 2D, cell 207*a* may be coupled to cell 207*b* with spacing connector 225, and to cell 207*c* with spacing connector 226; and a spacing connector 227 may couple cells 207*b* and 207*c*. The spacing connectors 225, 226 and 227 may, in some implementations, provide sufficient spacing between corresponding cells 207*a*, 207*b* and 207*c* such that a user of markers disposed in those cells 207*a*, 207*b* and 207*c* may be able to easily grasp the markers (that is, spacing connectors 225, 226 and 227 may provide room for the user's fingers to fit between adjacent markers).

In some implementations, a spacing connector may be about 3-5 mm (e.g., length 224); in other implementations, a spacing connector plus the thickness of the walls of two adjacent cells (where wall thickness is the thickness of a cell between its outer wall 220 and inner wall 223) may be about 10-15 mm (e.g., length 225 in FIG. 2D); in still other implementations, the spacing connector (e.g., length 224) or distance between the inside of adjacent cells (e.g., length 225) may be differently dimensioned (e.g., about 5 mm, about 10 mm, about 25 mm, about 10-30 mm, about 50 mm, etc.). (As used herein, "about" or "approximately" or "substantially" may mean within 1%, or 5%, or 10%, or 20%, or 50% of a nominal value).

Variation in height of rows (e.g., variation between a height 219 and a height 221 in FIG. 2F) may be configured to make visible indicia 130 (e.g., color labels or color-coded bands; see FIG. 1) of markers disposed in adjacent rows of the marker holder 101. For example, in some implementations, differences between height 219 and height 221 may be about 5 mm, 10 mm, 15 mm, 25 mm, or more. Spacing between the cells (e.g., provided by the spacing connectors 225, 226 and 227 in FIG. 2D) may also enable a user to distinguish between adjacent markers, for example, by making more visible, caps 110 of the markers, which, in some implementations, may be color-coded.

In some implementations, the marker holder 201 may be configured to have more mass in particular regions than in other regions. For example, with reference to FIG. 2F, some implementations may have a top portion 230 and a bottom portion 233. The bottom portion may be defined by the bottom plane 219 (when the marker holder 201 is sitting flat, as shown) and another intermediate (e.g., parallel) plane that is either halfway (e.g., at height 236) to the top of a row having height 219 (e.g., plane 237), or halfway (e.g., at height 240) to the top of a row having height 221 (e.g., plane 240); and in some implementations, the bottom portion 233 may have more mass than the top portion 230. In such implementations, this increased mass in the bottom portion 233 may lower the center of mass of the marker holder 201, making it more stable than other arrangements, especially when markers are disposed in the marker holder 201. In some implementations, a bottom portion 233 and top portion 230 may be distinguished from each other by planes or boundaries other than the plane 237 or plane 240.

Figure 2G:
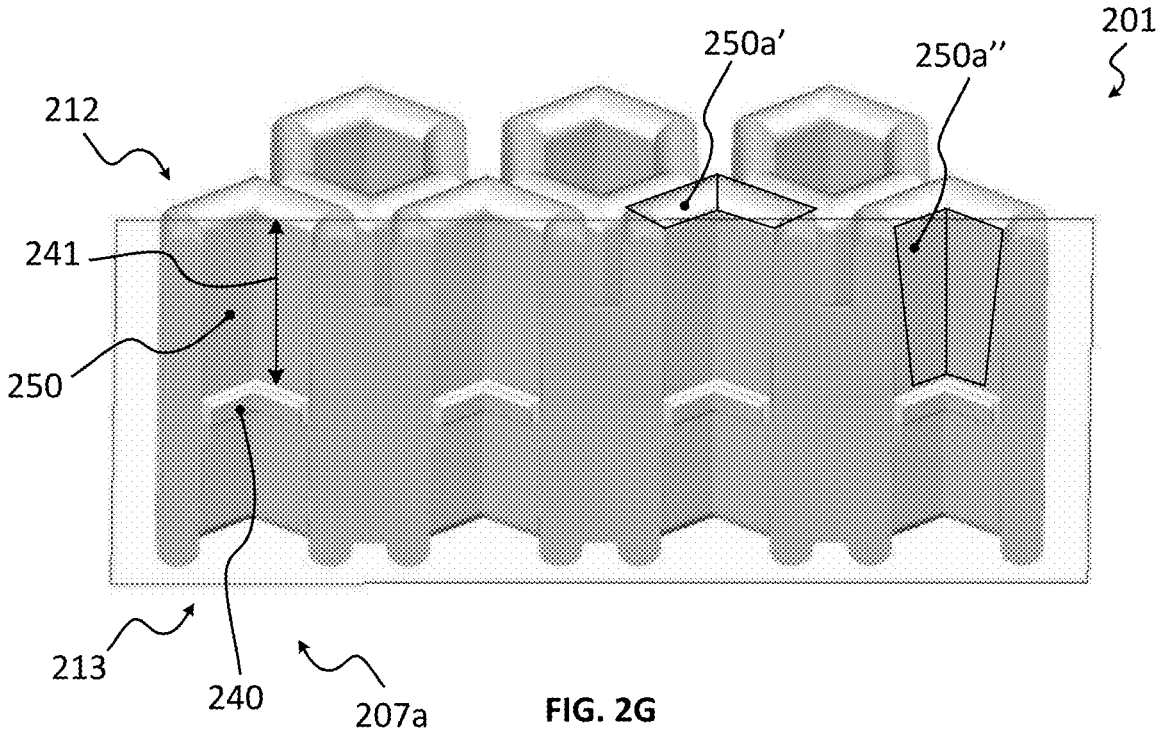
FIG. 2G illustrates a cross section of the marker holder of FIG. 2A, taken along the section line A-A shown in FIG. 2C.

In some implementations, the extra mass may come from the additional of material or mass-increasing features, such as ridges 240 in one or more cells, as shown in FIG. 2G—which is a cross section of the marker holder 201, taken along section lines A-A shown in FIG. 2C. Such ridges 240, when present, may serve other purposes, besides increasing mass of a particular portion. For example, the ridges 240 may prevent a marker or marker cap from being disposed too deeply into a corresponding cell. As another example, such ridges 240 may facilitate gripping of markers of different diameters—that is, a main portion 241 of the cell 207*a* may be configured to grip a marker having a first diameter, and the ridges 240—which may be disposed on each wall of the cell 207*a*—may be configured to grip a marker having a second diameter that is smaller than the first diameter.

Figure 2H:
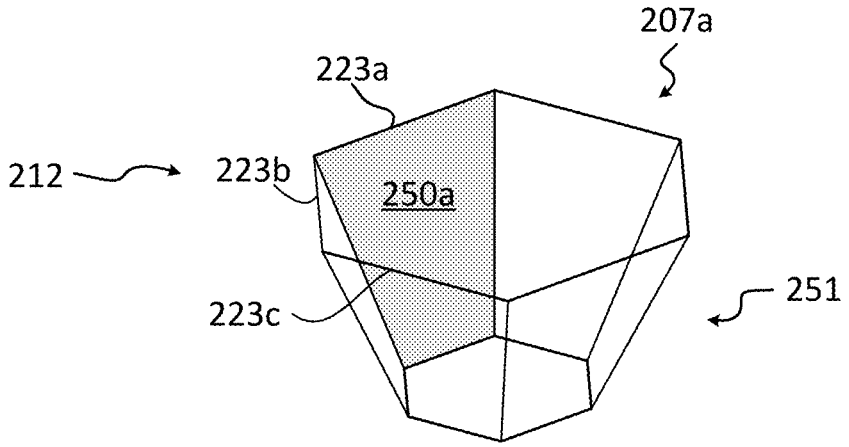
FIG. 2H illustrates an exemplary inverted pyramid structure.

Other features may facilitate gripping of markers having various diameters. For example, in some implementations, an inner wall 250 of the cell 207*a* may narrow from a top 212 of the cell 207*a* to the bottom 213 of the cell 207*a*. Turning to FIG. 2H, with reference to FIGS. 2D and 2G, inner wall segments 223*a*, 223*b* and 223*c* may decrease in width the farther away from the top edge 212 those segments are. As shown, this decreased width may cause the wall segments (e.g., wall segment 250*a*) to narrow (e.g., in an approximately trapezoidal shape)—creating a bounded inner volume that, in some implementations, may take the form of an inverted (e.g., hexagonal) pyramid 251.

In some implementations, such an inverted pyramid 251 may be present only at the very top of a cell 207*a* (e.g., near the top edge 212—as partially depicted in FIG. 2G with inner wall 250*a*'); in other implementations, such an inverted pyramid may extend deep (e.g., at least about halfway) into a cell 207*a* (e.g., along the length 241 shown in FIG. 2G, or beyond—as partially depicted in FIG. 2G with inner wall 250*a*").

Regardless of the precise dimensions or extent, the inverted pyramid 251 may facilitate smooth accommodation and introduction of a marker into the cell 207*a*. Moreover, in some implementations, such an inverted pyramid 207*a* may accommodate markers of different diameters. For example, larger-diameter markers may be accommodated and gripped higher up in the cell 207*a* (e.g., closer to the top edge 212); while smaller diameter markers may be accommodated and gripped deeper in the cell 207*a* (e.g., closer to the bottom edge 213).

The foregoing describes an inverted pyramid. Such an inverted pyramid may have three faces, four faces, five faces, six faces (as shown), seven faces, eight faces, etc. The edges may be straight or rounded, and the faces may similarly be planar or curved. Narrowing of the inverted pyramid may be linear or vary with some other function. The inverted pyramid, in some implementations, may approximate or be an inverted cone (e.g., with substantially no edges or discrete faces). Some implementations may employ only a portion of a pyramid. Other variations are contemplated that may facilitate gripping of markers of varying diameters.

Figure 3A:
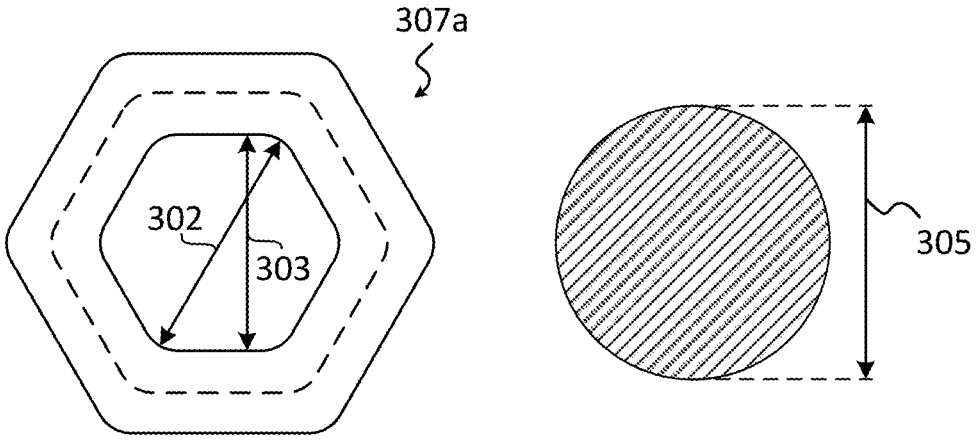
FIG. 3A illustrates exemplary dimensions of a cell and a marker for which the cell is configured to accommodate and grip.
Figure 3B:
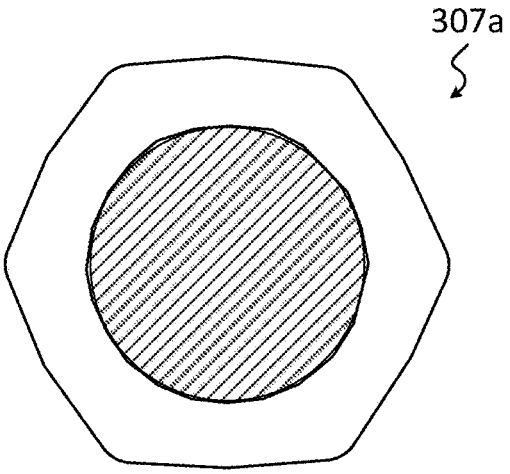
FIG. 3B depicts exemplary deformation of the cell of FIG. 3A, as it accommodates and grips a marker for which it is configured.

To further accommodate markers of varying diameter, the material of a marker holder, in some implementations, may be flexible. Turning to FIG. 3A, some portions of an exemplary cell 307*a* may be dimensioned to be less than dimensions of a marker for which the cell 307*a* is configured to accommodate and grip. For example, in some implementations, both a long dimension 302 and a short dimension 303 may be less than a diameter 305 of a marker for which the cell 307*a* is configured. The material of the cell 307*a* may be selected to deform (e.g., stretch) to accommodate the marker (e.g., specifically, its cap) while firmly gripping it (e.g., to facilitate removal, by a user of the marker portion, leaving the corresponding marker cap in the cell 307*a*). FIG. 3B illustrates an exemplary cell 307*a* that has been dimensioned as just described—showing how it may be deformed to accommodate and grip a marker for which it is configured.

In implementations such as those just described, spacing connectors may further accommodate stretching and deformation of individual cells, while providing space for users to reach fingers and hands between adjacent markers to grasp and withdraw from a marker holder a specific marker.

Several implementations have been described with reference to exemplary aspects, but it will be understood by those skilled in the art that various changes may be made and equivalents may be substituted for elements thereof without departing from the contemplated scope. For example, this disclosure references markers and their caps; but the devices and methods described herein may equally apply to other writing instruments (e.g., pens, pencils), whether capped or uncapped, or other art supplies (e.g., paintbrushes, crayons, chalk, colored pencils, sculpting tools, etc.). Marker holders are illustrated and described having three rows of cells, arranged in a honeycomb pattern; but other arrangements are possible—with different numbers of rows, different numbers of cells, and arrangements other than in a honeycomb (e.g., in parallel rows, in a grid arrangement, in a straight line, in a circular arrangement, in concentric circles, with multiple cells, with a single cell, etc.). Marker holders that are arranged in a honeycomb pattern, as illustrated, may be further colored or have indicia thereon (e.g., an image of a honeybee or a logo that includes such an image; texturing in the shape of drips of honey, texturing or imagery in the shape of honeycomb, etc.) to evoke a honey or honeybee theme or trade dress—for example, the material may be an orange, gold, yellow, amber, brown, or other color that evokes a honey-related or honeybee-related theme. Other implementations may be unrelated to honey or honeybees and may have other colors (e.g., blue, black, white, pink, green, purple, etc.). Spacing connectors may be longer or shorter (or absent) in some implementations. Dimensions (height, width) may vary. Variation between cell height from row-to-row or cell-to-cell may be more or less than illustrated, and the variation may be regular (e.g., cells within a row may have a common height) or irregular (e.g., each cell may have a different height than one or more adjacent cells). Cells within a marker holder may be similarly dimensioned, or cells may vary within a single marker holder (e.g., some cells may accommodate wider markers and others narrower markers; or cells may vary in types of instruments and supplies that may be accommodated). Cell shape may be different than shown—e.g., having a cross section that is a triangle, a square, a pentagon, a hexagon, a heptagon, an octagon, etc. Cells may have cross-sectional shapes that are other than polygons—e.g., circles, ovals, ellipses, slots, etc. Inverted pyramids may be truncated (e.g., to have flat, rather than pointed apexes). Longitudinal axes of each cell may be parallel to each other, as generally shown; or cells may be oriented differently from each other, such that their longitudinal axes are not all parallel to each other. Material of the marker holder may vary and may include silicone, rubber, plastic, nitrile, vinyl, neoprene, polyurethane, or variations or combinations thereof (e.g., fluorosilicone rubber, butyl rubber, styrene-butadiene rubber (SBR), ethylene propylene diene monomer (EPDM) rubber, etc.). The flexibility and compressibility of the material may vary. For example, some implementations may comprise a material with a Shore A durometer of between 25 and 80, 30 and 70, 45 and 65, etc.

Many other variations are possible, and modifications may be made to adapt a particular situation or material to the teachings provided herein without departing from the essential scope thereof. Therefore, it is intended that the scope include all aspects falling within the scope of the appended claims.

What is claimed is:

1. A stand comprising:

a plurality of cells, each cell having an outer wall, an inner wall, a bottom edge, and a top edge separated from the bottom edge by a height; wherein a perimeter of the outer wall comprises a first plurality of segments, the first plurality of segments forming a hexagon; and wherein a perimeter of the inner wall comprises a second plurality of segments, each segment in the second plurality of segments being substantially parallel to a corresponding segment in the first plurality of segments;

wherein the plurality of cells are arranged such that the bottom edge of each cell is aligned to a bottom plane, such that the plurality of cells can be disposed on a flat surface, and wherein the plurality of cells are further arranged in at least a first row and a second row, wherein cells in the first row have a first height, and cells in the second row have a second height that is greater than the first height; wherein each cell is coupled to at least one adjacent cell with a spacing connector that maintains separation space between the outer wall of the cell and the outer wall of the adjacent cell.

2. The stand of claim 1, wherein the plane is perpendicular to a longitudinal axis of one or more cells in the plurality of cells.

3. The stand of claim 1, wherein cells in the first row and cells in the second row are offset, such that the plurality of cells is arranged in a honeycomb pattern.

4. The stand of claim 3, wherein a material comprising the plurality of cells is colored orange, gold, brown or amber.

5. The stand of claim 3, further comprising indicia that is configured to evoke a honey-related or honeybee-related theme.

6. The stand of claim 1, wherein the cells comprise at least one of silicone or rubber.

7. The stand of claim 1, wherein the cells comprise a material having a Shore A durometer of between 25 and 80.

8. The stand of claim 1, wherein the second height is greater than the first height by at least 5 mm.

9. The stand of claim 1, wherein the cells comprise a material having a coefficient of friction that is greater than plastic.

10. The stand of claim 1, wherein one or more cells in the plurality of cells comprise ridges that extend out and away from inner walls of the one or more cells.

11. The stand of claim 1, wherein each segment in the second plurality of segments narrows from the top edge toward the bottom edge, such that the inner wall bounds a volume in the shape of an inverted pyramid or portion thereof.

12. The stand of claim 11, wherein the inner wall bounding the volume is disposed only at the top of corresponding cells in the plurality of cells.

13. The stand of claim 11, wherein the inner wall bounding the volume extends at least about halfway into corresponding cells in the plurality of cells.

14. The stand of claim 11, wherein edges of the inverted pyramid are rounded.

15. The stand of claim 11, wherein the inverted pyramid has three faces, four faces, five faces, six faces, seven faces or eight faces.

16. The stand of claim 1, wherein each spacing connector and cell are configured such that a segment of an inner wall of a first cell and a parallel segment of an adjacent second cell are separated by at least 10 mm.

17. The stand of claim 1, wherein the plurality of cells comprises a bottom portion and a top portion, the bottom portion extending from the bottom edge to an intermediate plane; the top portion comprising that remaining portion of the plurality of cells that is not included in the bottom portion; wherein a mass of the bottom portion is greater than a mass of the top portion.

18. The stand of claim 17, wherein the intermediate plane that is parallel to the bottom plane and disposed (i) halfway to a top edge of a cell in the plurality of cells having the lowest height, (ii) halfway to a top edge of a cell in the plurality of cells having the highest height, or (iii) at a level between (i) and (ii).

19. A stand comprising:

a plurality of cells, each cell having an outer wall, an inner wall, a bottom edge, and a top edge separated from the bottom edge by a height; wherein a perimeter of the outer wall comprises a first plurality of segments; and wherein the inner wall comprises a second plurality of segments, each segment in the second plurality of segments being substantially parallel to a corresponding segment in the first plurality of segments;

wherein the plurality of cells are arranged such that the bottom edge of each cell is aligned to a bottom plane, such that the plurality of cells can be disposed on a flat surface, and wherein the plurality of cells are further arranged in at least a first row and a second row, wherein cells in the first row have a first height, and cells in the second row have a second height that is greater than the first height; wherein each cell is coupled to at least two adjacent cells with spacing connectors, the spacing connectors extending from the outer wall of the cell to outer walls of the at least two adjacent cells, such that a separation is maintained of at least about 10 mm between the outer wall of the cell and the outer walls of the at least two adjacent cells.

20. A stand comprising:

a plurality of cells, each cell having an outer wall, an inner wall, a bottom edge, and a top edge separated from the bottom edge by a height;

wherein a perimeter of the outer wall comprises a first plurality of segments; and wherein a perimeter of the inner wall comprises a second plurality of segments, each segment in the second plurality of segments being substantially parallel to a corresponding segment in the first plurality of segments; wherein each segment in the second plurality of segments narrows from the top edge toward the bottom edge, such that the inner wall bounds a volume in the shape of an inverted pyramid or portion thereof;

wherein the plurality of cells are arranged such that the bottom edge of each cell is aligned to a bottom plane, such that the plurality of cells can be disposed on a flat surface, and wherein the plurality of cells are further arranged in at least a first row and a second row, wherein cells in the first row have a first height, and cells in the second row have a second height that is greater than the first height; wherein each cell is coupled to at least two adjacent cells with spacing connectors, the spacing connectors extending from the outer wall of the cell to outer walls of the at least two adjacent cells, such that a separation is maintained between the outer wall of the cell and the outer walls of the at least two adjacent cells.

* * * * *